US005453154A

United States Patent [19]

Thomas et al.

[11] Patent Number: 5,453,154

[45] Date of Patent: Sep. 26, 1995

[54] METHOD OF MAKING AN INTEGRATED CIRCUIT MICROWAVE INTERCONNECT AND COMPONENTS

[75] Inventors: Michael E. Thomas, Milpitas; Irfan A. Saadat, Santa Clara; Michael A. Glenn, Portola Valley, all of Calif.

[73] Assignee: National Semiconductor Corporation, Santa Clara, Calif.

[21] Appl. No.: 153,078

[22] Filed: Nov. 15, 1993

Related U.S. Application Data

[63] Continuation of Ser. No. 779,928, Oct. 21, 1991, abandoned.

[51] Int. Cl.[6] ..... B44C 1/22

[52] U.S. Cl. ..... 216/18; 437/203; 437/195; 437/51; 437/927; 333/254; 333/260; 427/96; 216/19

[58] Field of Search ..... 437/203, 927, 437/246, 195; 333/239, 248, 254, 260; 156/630, 656

[56] References Cited

U.S. PATENT DOCUMENTS

| | | | |
|---|---|---|---|
| 3,157,847 | 11/1964 | Williams | 333/239 |
| 4,455,537 | 6/1984 | La Prade et al. | 333/246 |
| 4,657,322 | 4/1987 | Grellmann et al. | 439/592 |
| 4,787,691 | 11/1988 | Lorenzo et al. | 357/56 |
| 4,789,642 | 12/1988 | Lorenzo | 437/24 |
| 4,857,973 | 8/1989 | Yang | 357/15 |
| 4,933,743 | 6/1990 | Thomas | 357/71 |
| 4,983,543 | 1/1991 | Sato et al. | 437/200 |
| 5,349,217 | 9/1994 | Boysel | 156/636 |
| 5,378,306 | 1/1995 | Cibulsky et al. | 156/630 |

FOREIGN PATENT DOCUMENTS

| | | | |
|---|---|---|---|
| 0030207 | 2/1983 | Japan | 156/630 |

OTHER PUBLICATIONS

"Fields and Waves in Communication Electronics", Second Edition, Ramo, Whinney, and Van Dizer, Wilay, New York 1984, pp. 410–417, 551, 554, 725.

*Primary Examiner*—Brian E. Hearn
*Assistant Examiner*—Lynne A. Gurley
*Attorney, Agent, or Firm*—William H. Murray

[57] ABSTRACT

An integrated circuit microwave interconnect is formed upon a surface by disposing a dielectric layer over the surface and patterning the dielectric layer to form a dielectric region. The dielectric region is then surrounded by a surrounding metal layer. In one embodiment the surface may be a non-metal upon which a metal layer is disposed prior to disposing the dielectric layer. In this embodiment an additional metal layer is disposed adjoining the first metal surface on both sides of the dielectric region after patterning the layer to form the dielectric region. Thus, the two metal layers thereby form the surrounding metal layer around the dielectric region. The microwave interconnect may be formed upon the surface of the substrate, above the surface of the substrate in a floating configuration, or in a trench within the substrate. An opening may be provided through the surrounding metal layer and a second dielectric region, in communication with the first dielectric region by way of the opening, may be formed. The second dielectric region is also surrounded by metal to provide a three-dimensional microwave interconnect. The dielectric material within the surrounding metal layers may be removed by an etching process and a vacuum, partial vacuum, or inert gas may be provided within the surrounding metal layers.

13 Claims, 7 Drawing Sheets

METHOD OF MAKING AN INTEGRATED CIRCUIT MICROWAVE INTERCONNECT AND COMPONENTS

This is a continuation of application Ser. No. 07/779,928 filed on Oct. 21, 1991, now abandoned, Nov. 15, 1993.

BACKGROUND OF THE INVENTION

1. Field of the Invention

This invention relates to integrated circuit interconnects and in particular to integrated circuit interconnects adapted to propagate high frequency signals between active circuit elements.

2. Description of the Prior Art

With the advancement of very large scale integration circuit technology (VLSI), big gains in circuit speeds have been achieved. This permits a new class of integrated circuits which operate in the microwave, millimeter, and optical frequency regions, hereinafter for the sake of convenience, collectively referred to as microwaves. These advances require the introduction of new types of on-chip interconnects which can accommodate the high frequencies of operation. It is known in the art to provide interconnects such as a micro-coaxial interconnect as taught in U.S. Pat. No. 4,933,743 issued to Michael E. Thomas on Jun. 12, 1990.

The frequency requirements of these microwave circuits will eventually push well into the gigahertz range. This will especially true of bipolar emitter coupled logic devices and devices formed using gallium arsenide technology. The wavelength of a signal propagating along the interconnects in these cases can be substantially less than the edge dimensions of the die. This can cause problems with high speed interconnect coupling. Due to absorption, even optical fibers can not operate at these frequencies.

In addition, as the speed of device Operation increases, it will become necessary to match the overall circuit impedance with that of an external power source for optimal device efficiency with little reflected power. This will be especially true for very large-scale integrated microwave circuits.

It is known in the art to provide strip type waveguide systems known as microstrip lines. A microstrip line is an interconnect disposed over a large ground plane wherein a dielectric is disposed between the microstrip and the ground plane. These microstrips may serve as interconnects in the microwave frequency range. They have been applied to microwave applications within integrated circuits. It is also known how to provide impedance matching by changing the dimensions of the microstrip lines. However, the use of microstrip lines in very large scale integration applications is very difficult to implement and microstrip lines do not operate at very high frequencies without substantial degradation of fidelity.

SUMMARY OF THE INVENTION

An integrated circuit microwave interconnect is fabricated by surrounding a dielectric region with a metal layer. The dielectric region may be vacuum, gas, solid, or liquid. This permits micro-scale interconnects which can operate at very high frequencies. The operation of the microwave interconnects of the present invention follows from the solution of Maxwell's equations with the boundary conditions imposed by the metal walls around the dielectric of the interconnect as formed by the integrated circuit fabrication techniques. These boundary conditions permit certain modes of propagation for energy within the interconnect, for example, $TE_{01}$, $TM_{01}$, etc. There is a minimum cutoff frequency of propagation for each mode which is dependent on the dimensions of the interconnect. This cutoff frequency increases with decreasing dimensions of the interconnect. Because of the use of integrated circuit fabrication techniques, the interconnect of the present invention may have micrometer scale dimensions resulting in very high cutoff frequencies. The integrated circuit microwave interconnect of the present invention may be formed as a miniaturized hollow or filled interconnect. Thus the dielectric enclosed by the metal may be air, vacuum, a partial vacuum or a gas, such an inert gas. Furthermore, other related components may be constructed with dielectric material, ferrites or a combination of both dielectric material and ferrites, and a surrounding metal layer, for example, magic-tee, directional couplers, circulators. In addition, an entire interconnect network system including active and passive elements may be integrated on a single monolithic integrated circuit. For example, a system may be provided which consists of amplifiers, microwave interconnects, magic-tees, directional couplers, circulators, isolators, couplers, filters and other components integrated on a single chip.

DETAILED DESCRIPTION OF THE INVENTION

Figure 1A:
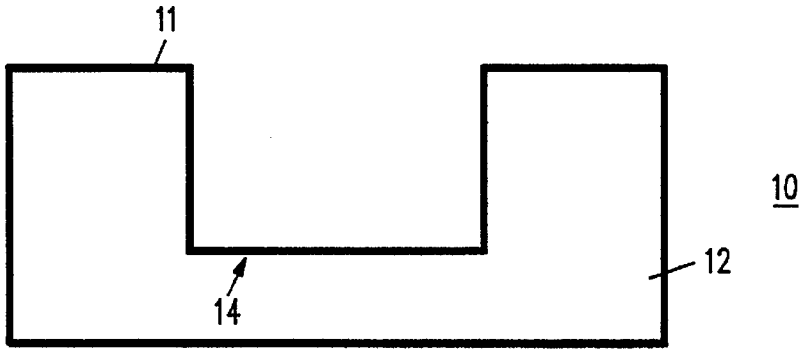
FIGS. 1A–F show a method for fabricating the integrated circuit microwave interconnect of the present invention.
Figure 1B:
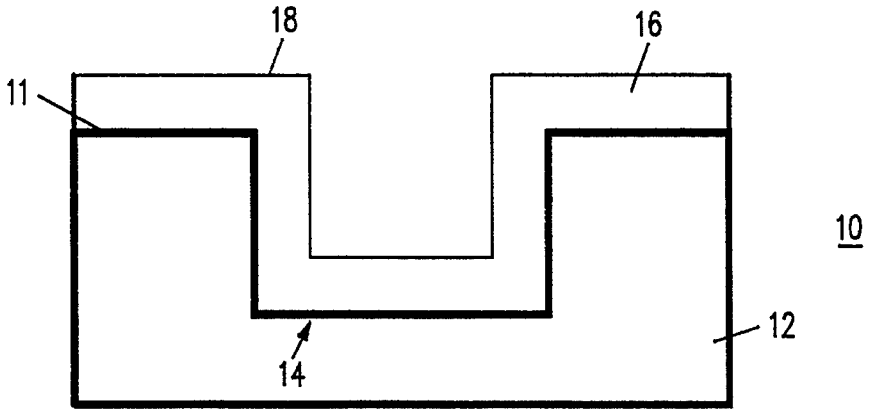
Figure 1C:
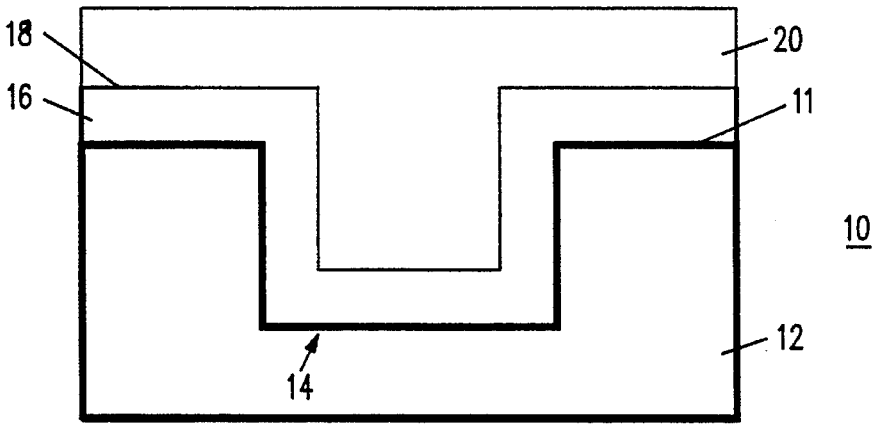
Figure 1D:
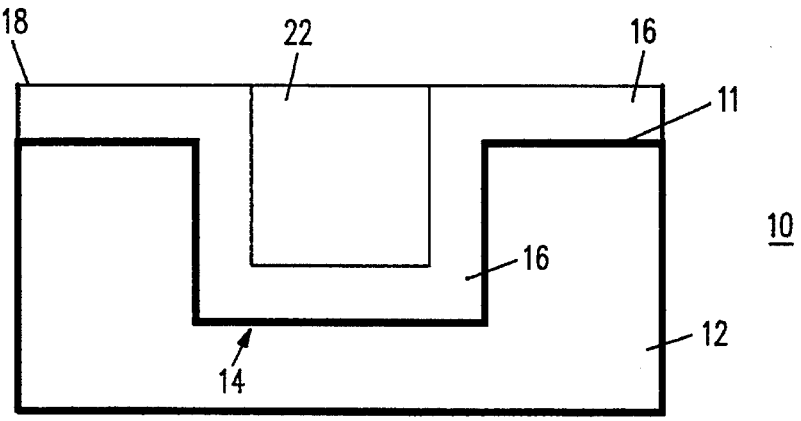
Figure 1E:
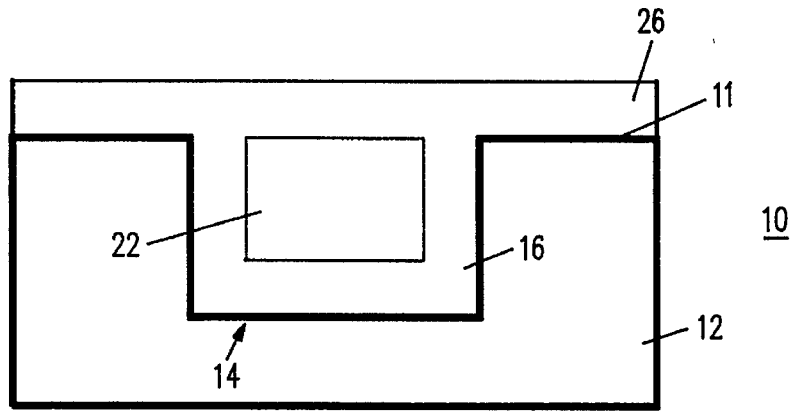
Figure 1F:
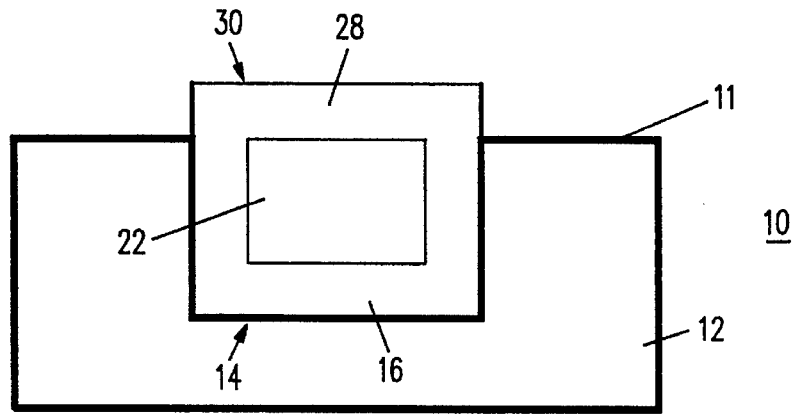

Referring now to FIGS. 1A–F, there is shown a method for making integrated circuit microwave interconnect 10 of the present invention. Microwave interconnect 12 may be disposed within microwave interconnect trench 14 or microwave interconnect channel 14 of substrate 12. Microwave interconnect trench 14 or channel 14 may be etched into substrate 12 in any conventional manner.

It will be understood by those skilled in the art that integrated circuit microwave interconnect 10 may be formed not only within microwave interconnect trench 14 or channel 14 within substrate 12. Integrated circuit microwave interconnect 10 may also be formed upon upper surface 11 of substrate 12 or above upper surface 11 of substrate 12 in a floating configuration. Formation of microwave interconnect device 10, both within microwave interconnect trench 14 or upon or above upper surface 11 of substrate 12 will be understood by those skilled in the art to constitute formation of integrated circuit microwave interconnect 10 over substrate 12.

Furthermore, substrate 12, over which integrated circuit microwave interconnect 10 is formed, may be a metal substrate 12 or a non-metal substrate 12. Non-metal substrate 12 may be formed of a conventional integrated circuit material such as a semiconductor. Additionally, it will be understood that substrate 12 of integrated circuit microwave interconnect 10 may be a printed circuit board, a multi-chip carrier, or any other type of substrate suitable for performing the fabrication steps set forth herein. Microwave interconnect 10 of the present invention has utility in new types of optics where light can be transmitted through microwave channels to provide high resolution imaging.

Referring now in particular to FIGS. 1A, B, there is shown substrate 12 for forming trench-type integrated circuit microwave interconnect 10 of the present invention. Substrate 12 may be formed of, for example, a thin film of silicon nitride disposed upon silicon. Microwave interconnect trench 14 or channel 14 may be formed within substrate 12 and a blanket deposition of metal layer 16 having an upper metal surface 18 is performed over substrate 12. The deposition of metal layer 16 over substrate 12 includes deposition upon the inner surfaces of microwave interconnect trench 14. It will be understood by those skilled in the art that deposition of metal layer 16 is not required in the formation of integrated circuit microwave interconnect 10 if substrate 12 is formed of a metal.

Referring now in particular to FIGS. 1C–F, dielectric layer 20 is disposed over the field of integrated circuit microwave interconnect 10, filling metal lined microwave interconnect trench 14. Dielectric layer 20 also extends over upper surface 18 of metal layer 16 which lines trench 14. Dielectric layer 20 is then patterned. This patterning may be performed by conventional masking and etching technique such as using, for example, sacrificial etching or by chemical mechanical polishing. If dielectric layer 20 is planarized, polishing is stopped at the level of upper metal surface 18 of metal layer 16.

This deposition and patterning of dielectric layer 20 forms dielectric region 22 or dielectric line 22 within microwave interconnect trench 14. Dielectric line 22 may be substantially elongated in the dimension perpendicular to the plane of the illustrated cross-section of microwave interconnect 10. It will be understood that patterned region 22 may be planar, circumferential, or any other geometric configuration. A further metal deposition is then performed to provide metal layer 26 over dielectric region 22 and upper surface 18 of metal layer 16.

Using conventional etching methods metal layer 26 may be removed except in the vicinity of dielectric line 22 leaving metal portion 28 above dielectric line 22 and microwave interconnect trench 14. Thus, surrounding metal layer 30 is formed around dielectric line 22. Surrounding metal layer 30 is formed of remaining portion 28 of metal layer 26 along with portions of deposited metal layer 16 upon the surfaces within microwave interconnect trench 14. Therefore, the end point in the process of fabricating integrated circuit microwave interconnect 10 may be either the depositing of metal layer 26 or the removal of portions of metal layer 26 to provide remaining portion 28.

It will be understood by those skilled in the art that if metal layer 26 is not removed except for remaining portion 28, that metal layer 26, along with the portions of metal layer 16 within microwave interconnect trench 14, form surrounding metal layer 30 of high frequency integrated circuit interconnect 10. Alternatively if portions of metal layer 26 are not removed metal layer 16 and metal layer 26 form surrounding metal layer 30.

As previously described, patterned region 22, surrounded by surrounding metal layer 30, may be formed as an elongated line 22. Such an elongated line 22 may be completely encircled by surrounding metal layer 30 either along its entire length or along just a portion of its length. It will be further understood that dielectric region 22 or dielectric line 22 surrounded by surrounding metal layer 30, when elongated, may extend for any distance. Additionally, patterned 22 may be formed, using conventional fabrication techniques known in the art, with right angles or any other angles in any horizontal or vertical direction. Additionally, it will be understood that dielectric line 22 may be disposed partly or entirely above the upper surface of substrate 12 provided dielectric line 22 is encircled by metal layer 30.

Finally, one or more openings (not shown) may be provided through surrounding metal layer 30 to permit an etch of dielectric line 22 from within surrounding metal layer 30. This etch permits the dielectric material of dielectric line 22 to be removed from within surrounding metal layer 30, causing surrounding metal layer 30 to be formed as an elongated substantially hollow tubelike structure. This etch step may be a conventional wet etch or vapor etch. While it is preferred that a plurality of openings through surrounding layer 30 be provided for the etch to remove dielectric line 22, it is believed that a single opening is sufficient if a substantially long etch time is provided. It will be further understood that this wet or vapor etch step may be performed if metal layer 26 is selectively removed leaving remaining portion 28 as part of surrounding metal layer 30 or if portions of metal layer 26 are not selectively removed. When material 22 is removed from within surrounding metal layer 30, material 22 is a sacrificial core and may be formed of metal, polymers, polyimide, or any other material which may be removed from within surrounding metal layer 30.

It will be understood by those skilled in the art that an opening provided through surrounding metal layer 30 for an etch of dielectric line 22 may be sealed using, for example, a conventional CVD process or PVD deposition while integrated circuit microwave interconnect 10 is disposed within a vacuum or a partial vacuum. This method provides a vacuum or a partial vacuum within substantially hollow surrounding layer 30 after the opening through layer 30 is closed. Furthermore, it will be understood that a selected gas, such as an inert gas, may be disposed within surrounding metal layer 30 before sealing the opening provided for the etch of dielectric region 22 to form surrounding metal layer 30 containing the selected gas.

Additionally, integrated circuit microwave interconnect 10 of the present invention permits the forming of on-chip optical integrated circuit interconnects. This includes a conventional interface (not shown) between a fiber optic device (not shown) and microwave interconnect 10 which can demodulate optical signals from the optical device and transmit the optical signals by way of microwave interconnect 10 of the present invention for on-chip signal processing. In optical neural networks, microwave interconnect 10 of the present invention may be used to create optical interconnects (not shown).

Additionally, microwave interconnect 10 may provide optical filters and attenuators and other related optical components. Microwave interconnect 10 of the present invention can provide optical resistors, for example, by changing the dielectric medium of the interconnect medium of integrated circuit microwave interconnect device 10 as will be described hereafter with respect to FIG. 4D. Additionally, integrated circuit microwave interconnect 10 of the present invention may be used to realize other optical integrated components.

Figure 2A:
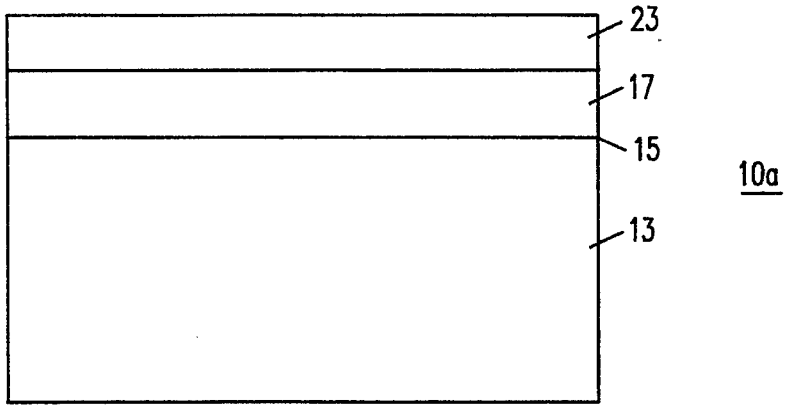
FIGS. 2A–C show an alternate method for fabricating the integrated circuit microwave interconnect of FIGS. 1A–F.
Figure 2B:
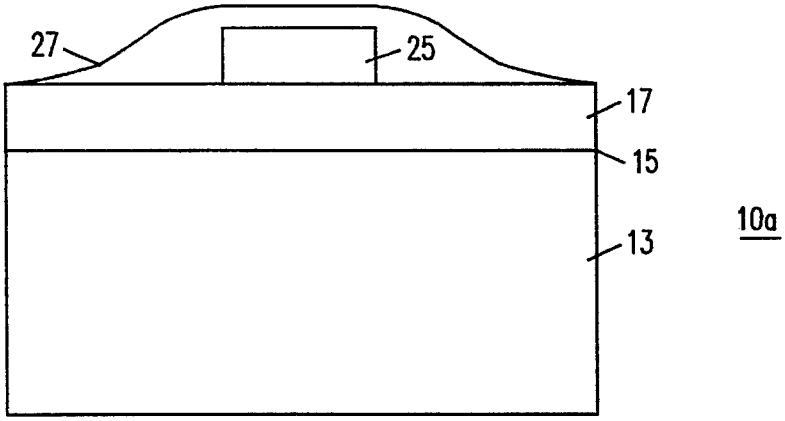
Figure 2C:
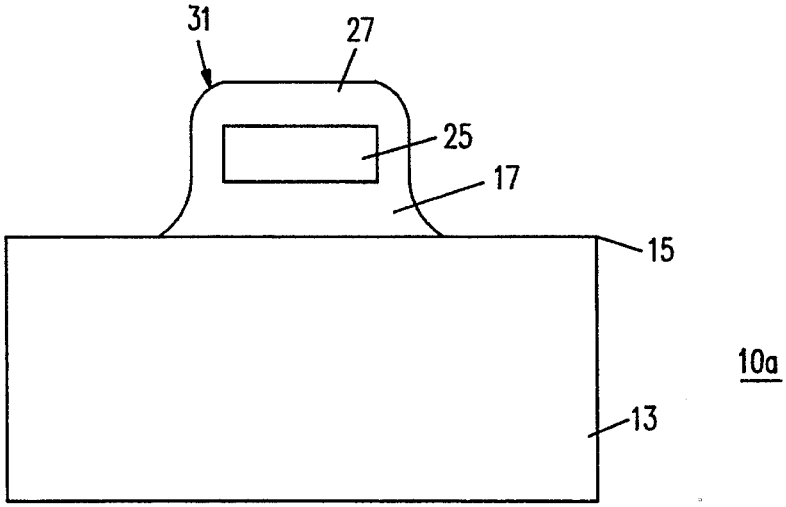
Figure 3A:
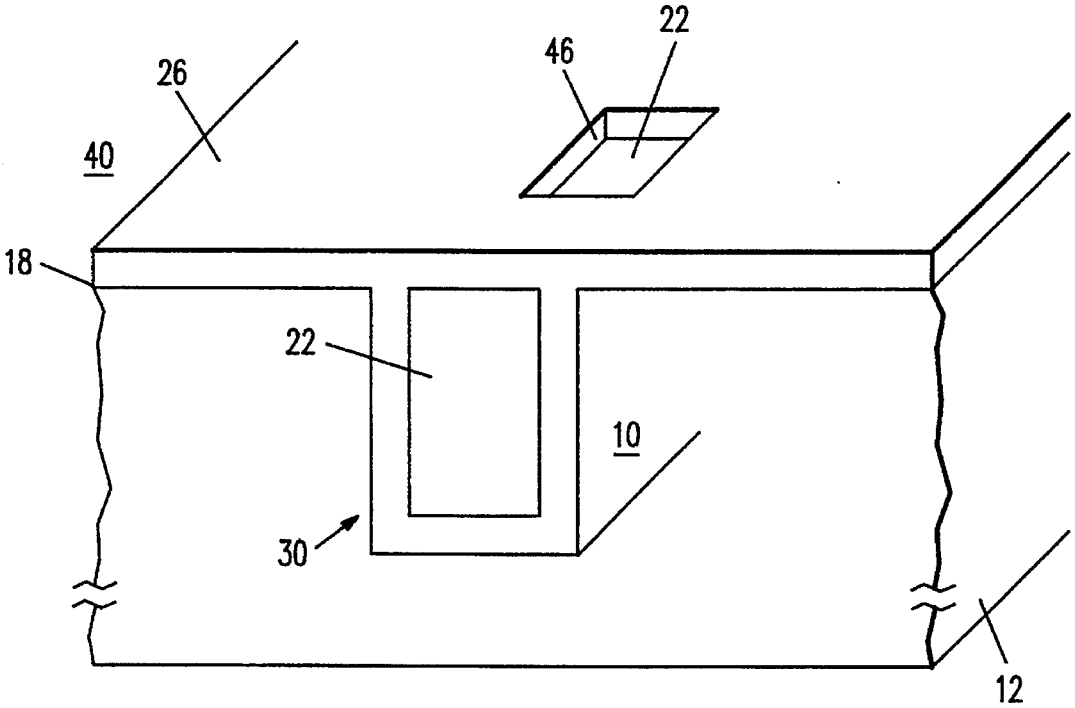
FIGS. 3A–D show a method for fabricating a three-dimensional integrated circuit microwave interconnect and a phase shifter from the integrated circuit microwave interconnect of FIGS. 1A–F.
Figure 3B:
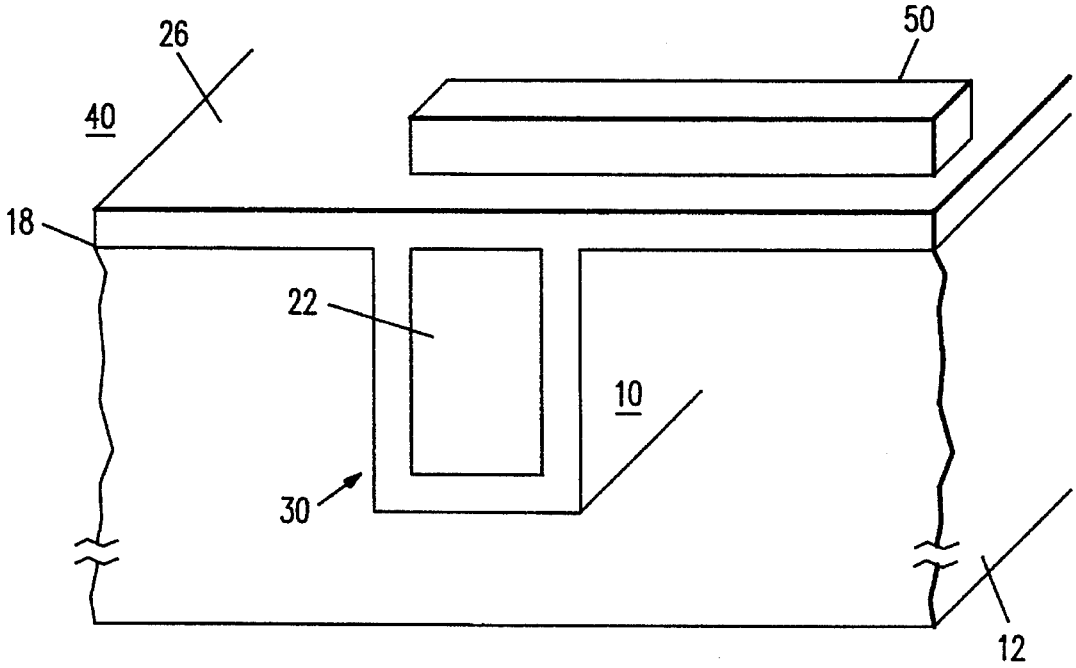
Figure 3C:
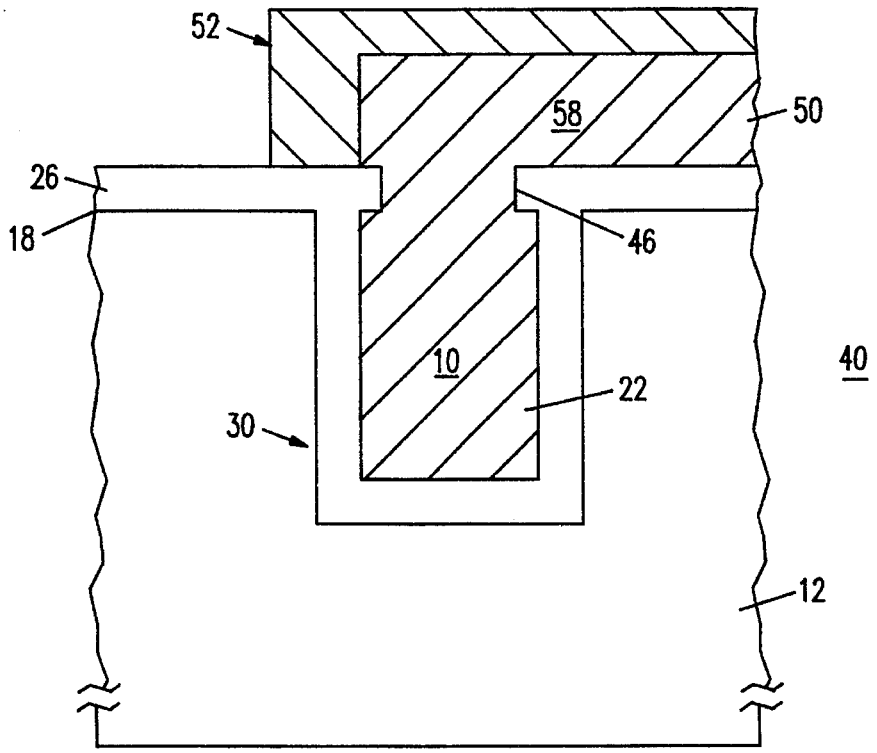
Figure 3D:
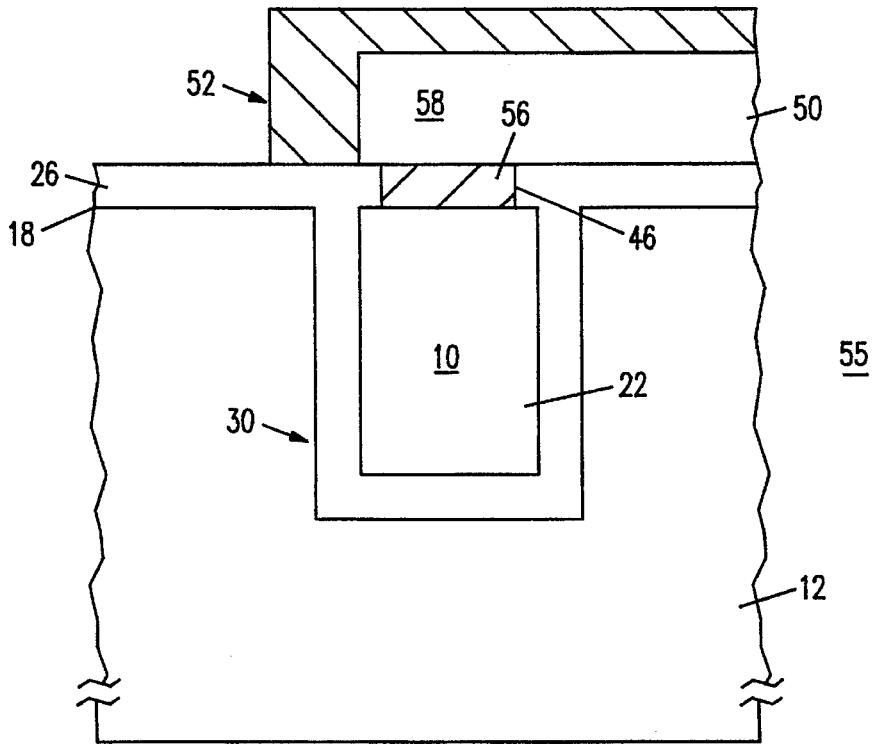

Referring now to FIGS. 2A–C, there is shown a method for fabricating non-trench type integrated circuit microwave interconnect 10*a*. Non-trench type microwave interconnect device 10*a* is an alternate embodiment of trench type integrated circuit microwave interconnect device 10 formed within microwave interconnect trench 14 of substrate 12. Non-trench type integrated circuit microwave interconnect 10*a* is formed over substrate 13 and above upper surface 15 of substrate 13 rather than within a trench below the level of surface 15 of substrate 13.

To form integrated circuit microwave interconnect 10*a*, metal layer 17 is disposed over upper surface 15 of substrate 13. It will be understood by those skilled in the art that the metal coating of substrate 13 formed by disposing metal layer 17 upon upper surface 15 is not necessary if integrated circuit microwave interconnect 10*a* is formed upon surface 15 of a substrate 13 formed of metal.

Dielectric layer 23 is disposed over the upper surface of metal layer 17 and patterned to form dielectric region 25 or dielectric line 25 upon metal layer 17. Dielectric line 25 may be an elongated dielectric line 25. Metal layer 27 is then disposed over dielectric line 25, covering dielectric line 25 and extending over regions of metal layer 17. It will be understood that the deposition of metal layer 27 may be the end point in the process of fabricating microwave interconnect 10*a*. Alternatively, metal layers 17, 27 may then be patterned by etching metal layers 17, 27 from above upper surface 15 of substrate 13 except in the vicinity of dielectric line 25.

Thus dielectric line 25 is surrounded by surrounding metal layer 31, wherein surrounding metal layer 31 is formed of the remaining portions of metal layer 17, disposed upon surface 15 of substrate 13 and metal layer 27. One or more openings (not shown) may be provided through surrounding metal layer 31 to permit removal of dielectric material 25 from within from surrounding metal layer 31 as previously described. For example dielectric material 25 may be removed from within surrounding metal layer 31 by a conventional wet or vapor etch process.

It will be understood by those skilled in the art that the opening to permit removal of dielectric material 25 may be sealed while non-trench type integrated circuit microwave interconnect 10*a* is disposed within a vacuum or within a partial vacuum. This step provides a vacuum or a partial vacuum within substantially hollow surrounding metal layer 31. The sealing of vacuum or partial vacuum interconnect 10*a* may be performed, for example, by a CVD process. Furthermore, it will be understood that a selected gas, such as an inert gas, may be disposed within surrounding metal layer 31 before sealing the opening provided for the removal of dielectric region 25, in order to provide surrounding metal layer 31 containing the selected gas.

Referring now to FIGS. 3A–D, there is shown a method for forming three-dimensional integrated circuit microwave interconnect 40 and phase shifter 55. Three-dimensional integrated circuit microwave interconnect device 40 may be formed from trench type integrated circuit microwave interconnect 10 or from non-trench type integrated circuit microwave interconnect 10*a*. Additionally, it will be understood by those skilled in the art that integrated circuit microwave interconnect 40 may be formed over any type of substrate used to form either microwave interconnect 10 or microwave interconnect 10*a*.

To form three-dimensional integrated circuit microwave interconnect device 40 from integrated circuit microwave interconnect 10, an opening 46 is provided in surrounding metal layer 30 of integrated circuit microwave interconnect 10, wherein it is understood that surrounding metal layer 30 surrounds dielectric material 22 of integrated circuit microwave interconnect device 10. Opening 46 extends through surrounding metal layer 30 to dielectric region 22 within surrounding metal layer 30.

A deposition of dielectric material 50 is performed over the surface of surrounding metal layer 30 including opening 46. Dielectric material 50 fills opening 46 and may extend over selected additional regions of metal layer 26. Dielectric layer 50, or dielectric region 50, is adapted to extend the entire distance through opening 46 to the level of dielectric material 22 within surrounding metal layer 30 and to make physical contact with dielectric region 22. Dielectric layer 50 may then be patterned into elongated dielectric region 50 or elongated dielectric line 50 by patterning and etching previously described with respect to dielectric line 22.

Metal layer 52 is disposed over dielectric line 50 in order to surround dielectric line 50 and form microwave interconnect 58. Dielectric line 50 is surrounded partially by patterned metal layer 52 and partially by metal layer 26 which is disposed above dielectric line 22 and upon surface 18 of microwave interconnect 10. Dielectric line 50, thus surrounded by metal layers 26, 52, is in contact with and joined to dielectric line 22. Contact between dielectric line 22 and dielectric line 50 is by way of opening 46 through surrounding metal layer 30.

Dielectric line 22 and dielectric line 50 may be removed from within respective surrounding metal layers 30, 52 of three-dimensional integrated circuit microwave interconnect 40 as follows. First, one or more openings (not shown) are formed through surrounding metal layer 52 as previously described. Dielectric line 22 and dielectric line 50 may then be etched through the openings. This etching process may be a conventional wet or vapor etch. Additionally, dielectric line 22 and dielectric line 50 may be etched by way of one or more openings (not shown) through a selected region of surrounding metal layer 30 around dielectric line 22. Furthermore, it will be understood by those skilled in the art that using lithographic and other conventional fabrication techniques, three-dimensional integrated circuit microwave interconnect 40 may be formed as a curved structure as well as a linear structure.

Phase shifter 55 may also be formed from trench type integrated circuit microwave interconnect 10 or from non-trench type integrated circuit microwave interconnect 10*a*. To form phase shifter 55, membrane 56 is defined only within opening 46 through surrounding metal layer 30. Dielectric line 22 is removed from within surrounding metal layer 30 and dielectric line 50 is removed from surrounding metal layer 52. Thus hollow microwave interconnect 58 is coupled to hollow interconnect 10 of non-linear phase shifter 55 by way of membrane 56. Membrane 56 of non-linear phase shifter 55 may be a ferrite or other non-etchable material so that it is not removed when dielectric line 22 or dielectric line 50 is removed. Membrane 56 is adapted to bond to metal layer 26 by adhesion.

Referring now to FIGS. 4A–E, it will be understood by those skilled in the art that it is possible to provide connections between a plurality of integrated circuit microwave interconnects 10, 10*a*, 40 for the purpose of forming a variety of structures for high frequency applications. These structures include circulator 60, directional coupler 70, magic tee 80, and optical switch 90. Conventional circulators, directional couplers, and magic tees are taught in "Fields and Waves in Communication Electronics" by Ramo, Whinney, and Van Duzer, published by Wiley and Sons, New York, in 1984. Integrated circuit microwave interconnects 10*b*-1 of circulator 60, directional coupler 70, magic tee 80 and switch 90 may be formed as previously described with respect to integrated circuit microwave interconnects 10, 10*a*, 40.

Figure 4A:
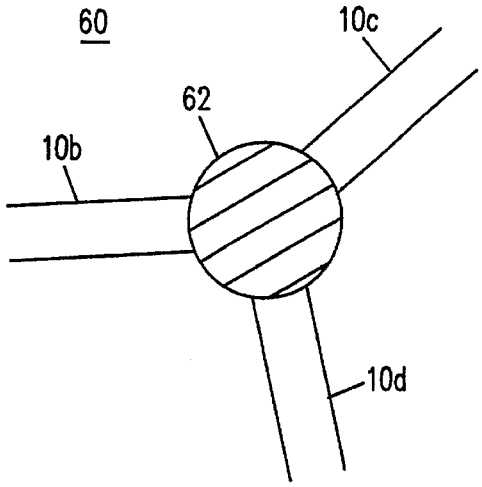
FIGS. 4A–E show various high frequency devices which may advantageously use the integrated circuit microwave interconnect of the present invention.

Referring now in particular to FIG. 4A, integrated circuit microwave interconnect circulator 60 is provided with central ferrite disk 62 and biased in a conventional manner. To form circulator 60, three microwave interconnects 10*b,c,d* are formed in the same manner as previously described with respect to microwave interconnect 10. Provided the boundary conditions are met, microwave interconnects 10*b,c,d* operate in the same manner as microwave interconnects 10, 10*a*. Interconnects 10*b,c,d* are formed to meet in the center of circular 60 to form central disk 62. Non-etchable material 62 is then deposited in the center of microwave circulator 60 to form central disk 62. It will be understood that central disk 62 may be formed as a square or other shapes if desired. The roles of microwave interconnects 10*b,c,d* of microwave interconnect circulator 60 may be rotated within circulator 60 such that excitation in one microwave interconnect 10*b,c,d* produces an output in one of the remaining microwave interconnects 10*b,c,d* but not the other. Thus it will be understood that those skilled in the art that circulator 60 functions like known circulators. Circulator 60 is then covered with metal.

Figure 4B:
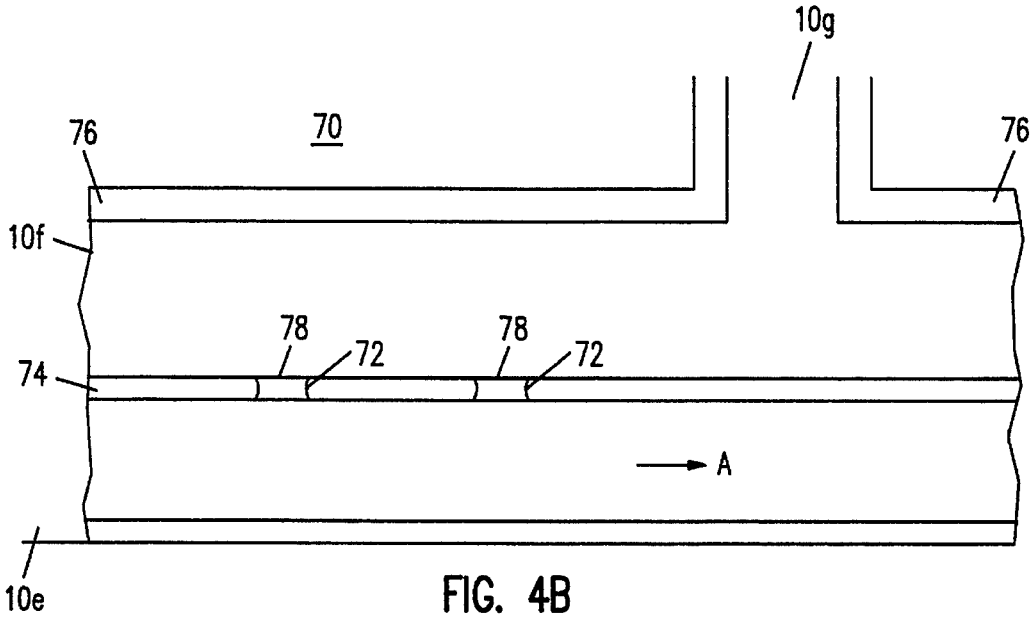

Referring now in particular to FIG. 4B, there is shown integrated circuit microwave interconnect directional coupler 70. Microwave interconnect 10*e* of directional coupler 70 is provided with a plurality of openings 72 through surrounding metal layer 74. Openings 72 may be separated by one-quarter of the wavelength of the selected waves of directional coupler 70. This permits energy from microwave interconnect 10*e* to be coupled to microwave interconnect 10*f* which is surrounded by metal layer 76. Coupled waves from interconnect 10*e*, which are coupled to microwave interconnect 10*f* by way of openings 72 and moving in the direction of arrow A, may then propagate by way of microwave interconnect 10*g*, of directional coupler 70. Openings 72 through surrounding layer 74 may be provided with membranes 78 to permit non-linear coupling of microwave interconnect 10*e* and microwave interconnect 10*f*.

Figure 4C:
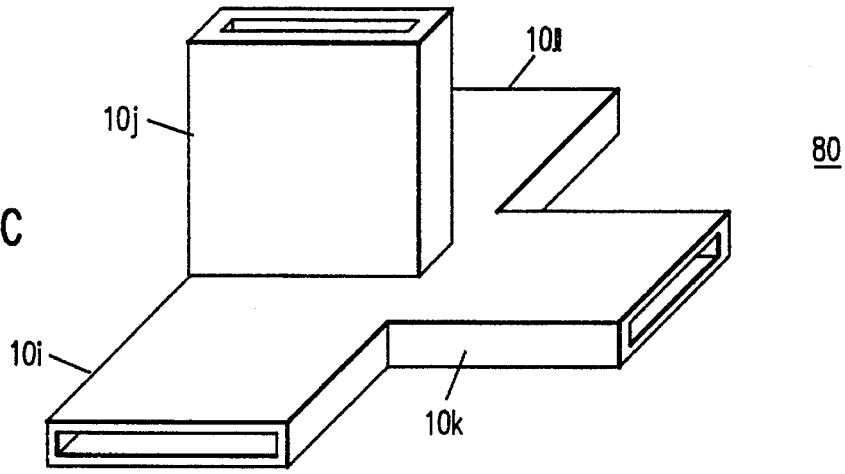

Referring now in particular to FIG. 4C, there is shown integrated circuit microwave interconnect magic tee 80. In magic tee 80, interconnects 10*i,j,k,l* are joined orthogonally. Thus, for example, a wave introduced into microwave interconnect 10*j*, from considerations of symmetry, may divide equally between interconnects 10*i,l*, but may not couple into interconnect 10*k*. The transmission, coupling, and scattering coefficients of magic tee 80 may be adjusted in accordance with conventional considerations with respect to the dimensions of interconnects 10*i,j,k,l* in a manner understood by those skilled in the art.

Figure 4D:
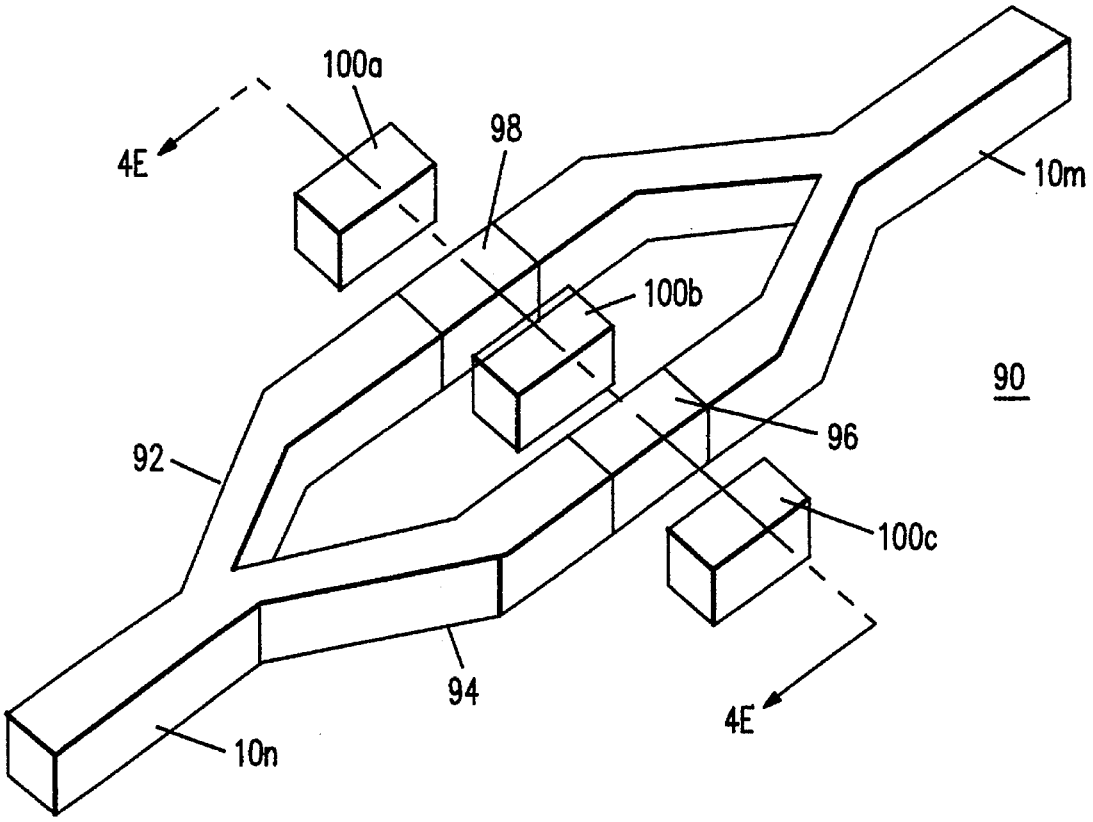
Figure 4E:
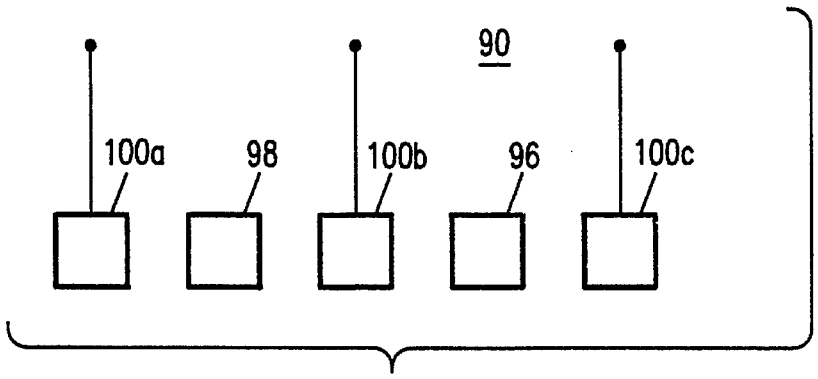

Referring now in particular to FIG. 4D,E, there is shown integrated circuit microwave interconnect switch 90. Within microwave interconnect switch 90, microwave interconnect 10*n* is applied to two microwave interconnect branches 92, 94. Microwave interconnect branches 92, 94 of microwave interconnect switch 90 are provided with switch control regions 96, 98. At least one switch control region 96, 98 may be controlled with energy from either an electric field or a magnetic field in order to alter the propagation characteristics of interconnect branches 92, 94 with respect to each other. It will be understood that the surrounding metal layer around switch control regions 96, 98 may be provided with holes (not shown) therethrough to permit external fields to be applied to the material within the surrounding metal layer in the vicinity of switch control regions 96, 98. These holes are not required if the surrounding metal layer is formed of a non-ferrous metal such as copper or brass. Additionally, holes are not required if the surrounding metal layer has a thickness equal to the skin depth of the frequency of energy applied to control regions 96, 98.

When control regions 96, 98 of microwave interconnect switch 90 are controlled by magnetic fields they are formed of ferromagnetic materials which may be deposited by conventional selective or non-selective deposition techniques. The ferromagnetic materials may be, for example, $CuFe_2O_4$, $NiFe_2O_4$, or $MnFe_2O_4$. It will be understood by those skilled in the art that switch control regions 96, 98 may be formed of any material having differing propagation characteristics when differing fields are applied to it. Energy transmitted through switch 90 in this manner may be filtered to remove the frequency of the control field. Alternately, the control field may modulate the transmitted energy.

When switch control regions 96, 98 are controlled by electric fields, the material of control regions 96, 98 may have anisotropic permeability or an anisotropic permitivity. For example, lead zirconium, titanate, or barium titanate. The electric fields which are applied to control regions 96, 98 of interconnect branches 92, 94 may be applied by any means such as conventional electrodes 100*a,b,c* formed of a conventionally used metal. The electrical fields applied to control regions 96, 98 of switch 90 by electrodes 100*a,b,c* thus change the propagation characteristics within microwave interconnect branches 92, 94 with respect to each other as previously described.

Microwave interconnect branches 92, 94 of microwave interconnect switch 90 are then combined so that the energy of branches 92, 94 may be applied to microwave interconnect 10*m*. The manner in which the energy of branch 92 and the energy of branch 94 combine is thus determined by the magnetic field applied to control regions 96, 98 by electrodes 100*a,b,c*. For example, the energy of branch 92 and the energy of branch 96 may interfere and combine destructively when applied to interconnect 10*m*. Alternatively, if the energy waves propagating through branch 92 and branch 94 are in phase, they may combine constructively. It will be understood by those skilled in the art that microwave interconnect switch 90 may be formed with more than two branches 92, 94 and that the branches of switch 90 need not be formed of equal length. Such a switch 90 (not shown) would be non-linear.

Thus another application of integrated circuit microwave interconnects 10, 10*a* is in microwave switches 90 wherein the propagation time of the microwave energy is modified by changing the dielectric characteristics of the dielectric medium in switch 90 using electrical and optical excitation. This results in constructive or destructive interference of the waves at the output of switch 90, resulting in a desired switching action. In imaging systems, this technique may be used for the creation of narrow beams of light for use in scanning images. Also, it may be used to transfer images from the pixels of an image. Integrated circuit microwave interconnects 10, 10*a* of the present invention also permit the construction of x-ray guides and diffraction gratings.

It will be understood that various changes in the details, material and arrangements of the parts which have been described in order to explain the nature of this invention, may be made by those skilled in the art without departing from the principle and scope of the invention as expressed in the following claims.

We claim:

1. A method of fabricating an integrated circuit microwave interconnect on a substrate, said method comprising the steps of:

(a) forming a trench in the surface of said substrate;

(b) disposing a first layer of metal over at least the inner surface of said trench;

(c) disposing a first layer of dielectric material in said trench over said first metal layer; and (d) disposing a second layer of metal over said first layer of dielectric material, said second metal layer adjoining said first metal layer on both sides of said first layer of dielectric material to form a surrounding metal layer which surrounds said first layer of dielectric material.

2. The method of fabricating an integrated circuit microwave interconnect of claim 1, comprising the further steps of:

(j) forming a first opening in said first surrounding metal layer;

(k) forming a second patterned region in communication with said first patterned region by way of said opening; and, (l) surrounding said second patterned region with a second surrounding metal layer.

3. The method of fabricating an integrated circuit microwave interconnect of claim 2, wherein step (k) comprises the steps of:

(m) disposing a second layer of dielectric material in said first opening and over at least a portion of said first surrounding metal layer; and, (n) patterning said second layer of dielectric material to form said second patterned region.

4. The method of fabricating an integrated circuit microwave interconnect of claim 1, comprising the further step of removing said first patterned region from within said first surrounding metal layer.

5. The method of fabricating an integrated circuit microwave interconnect of claim 4, comprising the further steps of:

(o) forming a second opening in at least one of said first and second surrounding metal layers; and (p) removing at least one of said first and second patterned regions from within at least one of said first and second surrounding metal layers by way of said second opening.

6. The method of fabricating an integrated circuit microwave interconnect of claim 1, comprising the further steps of:

(q) forming a plurality of said microwave interconnect; and (r) coupling said microwave interconnects to each other.

7. The method of fabricating an integrated circuit microwave interconnect of claim 6, wherein step (r) comprises the step of coupling said microwave interconnects to each other to form a microwave directional coupler.

8. The method of fabricating an integrated circuit microwave interconnect of claim 6, wherein step (r) comprises the step of coupling said microwave interconnects to each other to form a magic tee.

9. The method of fabricating an integrated circuit microwave interconnect of claim 6, wherein step (r) comprises the step of coupling said microwave interconnects to each other to form a microwave circulator.

10. The method of fabricating an integrated circuit microwave interconnect of claim 1, comprising the further steps of:

(s) forming at least two microwave interconnect branches, at least one of said microwave interconnect branches having variable energy propagation characteristics for receiving energy and transmitting said energy in accordance with said variable energy propagation characteristics;

(t) coupling said microwave interconnect branches to said microwave interconnect to permit energy applied to said microwave interconnect to be received and transmitted by said microwave connect branches;

(u) forming energy source means adapted to apply further energy to said interconnect branch having said variable energy propagation characteristics to provide differing energy propagation characteristics between said microwave interconnect branches in accordance with said further energy.

11. A method of fabricating an integrated circuit microwave interconnect on a substrate in accordance with claim 1 wherein step (c) comprises the steps of:

(i) disposing said first layer of said dielectric material in said trench over said first metal layer; and (ii) removing said dielectric material from the field leaving said dielectric material only in said trench.

12. A method of fabricating an integrated circuit microwave interconnect on a substrate in accordance with claim 1 wherein said substrate comprises a metal substrate, said method comprising the steps of:

(a) forming said trench in the surface of said metal substrate;

(b) disposing said first layer of dielectric material in said trench; and (c) disposing said layer of metal over said first layer of dielectric material, said second metal layer adjoining said metal substrate on both sides of said first layer of dielectric material to form a surrounding metal structure which surrounds said first layer of dielectric material.

13. A method of fabricating an integrated circuit microwave interconnect on a substrate, said method comprising the steps of:

(a) providing a first layer of metal on a surface of said substrate;

(b) disposing a first layer of dielectric material over said first layer of metal;

(c) patterning said first layer of dielectric material to form a first patterned region;

(d) disposing a second layer of metal over said first patterned region, said second metal layer adjoining said first metal layer on both sides of first patterned region to form a surrounding metal layer which surrounds said first patterned region;

(e) removing said first patterned region from within said first surrounding metal layer;

(f) forming at least two microwave interconnect branches, at least one of said microwave interconnect branches having variable energy propagation characteristics for receiving energy and transmitting said energy in accordance with said variable energy propagation characteristics;

(g) coupling said microwave interconnect branches to said microwave interconnect to permit energy applied to said microwave interconnect to be received and transmitted by said microwave interconnect branches; and (h) forming energy source means adapted to apply further energy to said interconnect branch having said variable energy propagation characteristics to provide differing energy propagation characteristics between said microwave interconnect branches in accordance with said further energy.

* * * * *